United States Patent [19]

Marzotto

[11] Patent Number: 4,884,325

[45] Date of Patent: Dec. 5, 1989

[54] PROCESS FOR THE MANUFACTURE OF A BLANKET PRODUCT

[75] Inventor: Gaetano Marzotto, Cornedo, Italy

[73] Assignee: Manifattura Lane Gaetano Marzotto & Figli S.P.A., Vicenza, Italy

[21] Appl. No.: 114,672

[22] Filed: Oct. 29, 1987

[30] Foreign Application Priority Data

Oct. 31, 1986 [IT] Italy ..... 22209 A/86
Dec. 30, 1986 [IT] Italy ..... 22893 A/86

[51] Int. Cl.[4] ..... D06C 11/00; D06C 27/00

[52] U.S. Cl. ..... 28/160; 28/162; 28/29 R

[58] Field of Search ..... 28/158, 162, 160; 26/29 R

[56] References Cited

U.S. PATENT DOCUMENTS

| | | | |
|---|---|---|---|
| 1,114,501 | 10/1914 | McLead | 28/162 |
| 1,495,141 | 5/1924 | Amory | 28/162 X |
| 1,689,208 | 10/1928 | Mack | 26/29 R X |
| 2,012,184 | 8/1935 | Cobb | 28/162 X |
| 2,825,958 | 3/1958 | Chandler | 28/162 |
| 4,000,342 | 12/1976 | Rochelle et al. | 28/162 X |

*Primary Examiner*—Robert R. Mackey
*Attorney, Agent, or Firm*—Laff, Whitesel, Conte & Saret

[57] ABSTRACT

The process herein described provides the weaving of a manufactured product consisting of an upper fabric (2) made of cotton or any other suitable material and a lower fabric (3) with weft yarns (3*a*) made of wool and warp yarns (3*b*) interlaced with the weft yarns (2*a*) of the upper fabric (2). The weaving operation is followed by a printing step carried out on the upper fabric (2) of the manufactured product and by one or more teaseling steps on the lower fabric (3). Subsequent to each teaseling step there is a dimensional stabilization step of the manufactured product accomplished by a combined action consisting in moistening, heating and tensioning the product, the tensioning lasting until the end of the moistening and heating steps. A napping operation is also carried out together with the last teaseling step. By said process a blanket is obtained which comprises an upper fabric (2) with weft yarns (2*a*) interlaced with the warp yarns (3*b*) of a lower fabric (3). The lower fabric (3) has a teaseled and napped visible surface (6) and the upper fabric (2) a printed visibled surface (7).

6 Claims, 2 Drawing Sheets

PROCESS FOR THE MANUFACTURE OF A BLANKET PRODUCT

FIELD AND BACKGROUND OF THE INVENTION

The invention pertains to a process for the manufacture of blankets and to the product obtained from said process.

It is known that one of the most important features a blanket should have is its capability to offer a good heat-insulation, that is a high nonconducting property, while at the same time exhibiting low weight values per surface unit. It is also very important that the heat-insulation offered by the blanket should last in time even when the blanket is subjected to wear as a result of a protracted use as well as of several washings.

Traditional blankets currently produced are wholly or partially made of wool and during the production process with which they are concerned they generally undergo teaseling and napping operations on both of their surfaces. Said teaseling and napping operations substantially consist in raising, by means of suitable apparatuses, a thick down on the blanket surface by lifting part of the fibers forming the wool yarns. Between the fibers so disposed a plurality of very small air spaces is formed which enhances the nonconducting property of the blanket.

It has been noted however that when the blanket is washed and/or handled, the fibers constituting the teaseled and napped surface are almost always subjected to entanglement with each other thereby causing a surface shrinkage and, as a result, a remarkable reduction in the volume and number of the above mentioned air spaces. Said reduction obviously involves a decrease of the heat insulation offered by the blanket.

Blankets substantially consisting of two wool fabrics interlaced with each other through their respective weft or warp yarns have also been produced. Said linked fabrics directly obtained from a weaving step, are subsequently teaseled on their visible surfaces.

Said blankets have exhibited a greater insulating property than traditional blankets, their weight per surface unit being equal. This is due to the fact that we must add the insulation caused by a plurality of air spaces formed between the two fabrics, to that produced by the teaseling operation.

In spite of this advantage however, these blankets too as the traditional ones undergo a remarkable decrease of their insulating character when they are washed due to the shrinkage of the teaseled surfaces.

Furthermore, both types of blankets hereinbefore examined due to their particular nature, do not lend themselves to be decorated, in particular by printing. As a matter of fact, owing to the presence of teaseling, the dying substances would tend to spread unevenly by capillarity over the fibers forming said teaseled surfaces.

On the other hand, if the printing would be carried out before the teaseling step, the quality of the patterns printed on the semifinished products would be poor, due to the next teaseling step.

For the above reasons, when these blankets are used, it is also necessary to put a bedspread over them. The latter, generally made of printed material, is adapted to perform those ornamental functions that a blanket would not otherwise succeed in meeting.

SUMMARY OF THE INVENTION

Under this situation, it is an object of the present invention to provide a blanket which is capable of exhibiting a greater heat-insulation with respect to the traditional ones, its weight per surface unit being equal, and which at the same time does not lose part of its insulating properties as a result of subsequent washings.

A further object of the invention is to provide a blanket that is adapted to be easily printed with excellent results from a graphic standpoint.

To this end, the basic idea of the present invention is to use, for the accomplishment of said blankets, manufactured products substantially consisting of a first fabric having weft and warp made of cotton or other convenient material, coupled to a second fabric having a wool weft and the warp of which is interlaced with the weft of the first fabric.

Such manufactured products have been marketed for a long time but at the present state of the art they do not lend themselves to be used to make blankets. This is due to the fact that the wool part of these manufactured products is not teaseled, as a teaseling operation would cause a remarkable shrinkage of the wool which would result in wrinklings and creasings on the first fabric.

It is therefore apparent from the above that in order to achieve the above specified purposes, it is first of all necessary to solve the technical problem of carrying out the wool teaseling without causing the product being worked to shrink or, more generally, to alter its size.

It is possible to come to the solution of this technical problem and therefore to the achievement of the intended purposes by a process for the manufacture of blankets comprising the following steps:

- weaving of a manufactured product consisting of an upper fabric, the weft or warp yarns of which are interlaced with the warp or weft yarns, respectively, of a lower fabric, in the region of linking stitches formed by the latter; first washing of the manufactured product;
- teaseling of the manufactured product on the side of the lower fabric;
- dimensional stabilization of the manufactured product by a combined action consisting in moistening, heating and tensioning the manufactured product in the direction of the longitudinal extension of the teaseled yarns, said tensioning lasting until the end of the heating and moistening operations;
- teaseling and napping of the manufactured product on the side of the lower fabric;
- final dimensional stabilization of the manufactured product by a combined action consisting in moistening, heating and tensioning the manufactured product in the direction of the longitudinal extension of the teaseled and napped yarns, said tensioning lasting until the end of the heating and moistening operations.

Advantageously by the above process, there is obtained a blanket comprising an upper fabric, the weft or warp yarns of which are interlaced with the warp or weft yarns, respectively, of a lower fabric in the region of linking stitches formed by the latter, said lower fabric exhibiting a teaseled and napped visible surface.

BRIEF DESCRIPTION OF THE DRAWINGS

Further features and advantages will become more apparent from the detailed description of a preferred embodiment of a process for the manufacture of blankets and of a blanket obtained by said process according to the invention, given hereinafter by way of non-limiting example with reference to the accompanying drawings, in which.

DESCRIPTION OF THE PREFERRED EMBODIMENTS

Figure 1:
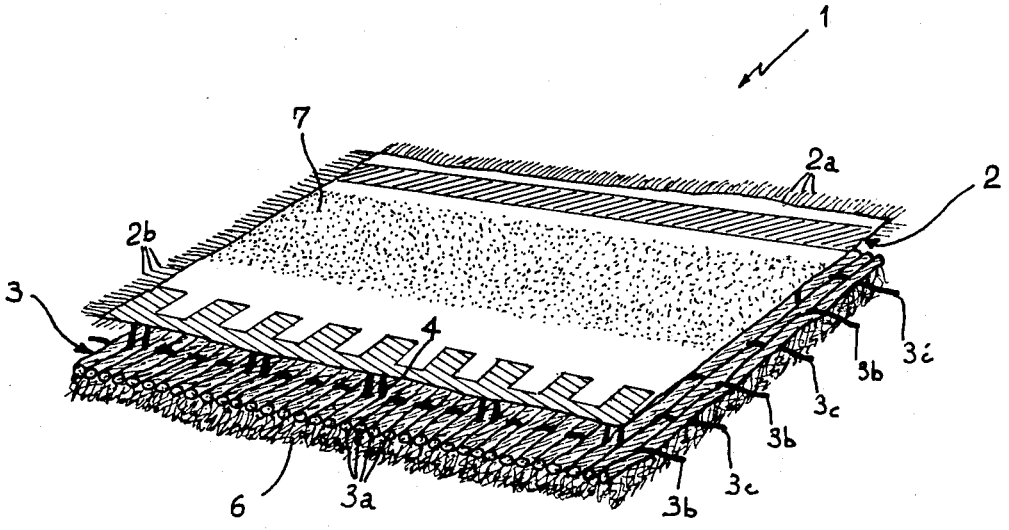
FIG. 1 is a perspective diagrammatic view, to an enlarged scale, of a blanket portion according to the invention.

Referring to the drawings, a blanket made by adopting the process of the present invention has been identified by reference numeral 1. Advantageously, blanket 1 consists of an upper fabric 2 formed with weft yarns 2*a* and warp yarns 2*b*. Underneath the upper fabric 2, there is a lower fabric 3 formed with weft yarns 3*a* and warp yarns 3*b*, where the warp yarns are mutually spaced apart by a predetermined distance.

In a preferred embodiment, the weft yarns 3*a* of the lower fabric 3 are made of wool, whereas the warp yarns 3*b* are preferably made of the same material as the upper fabric 2. For the manufacture of the upper fabric wool, cotton, silk, synthetic fibers, vegetable or animal fibers may be indifferently used depending upon the quality characteristics that it is wished to achieve.

Figure 3:
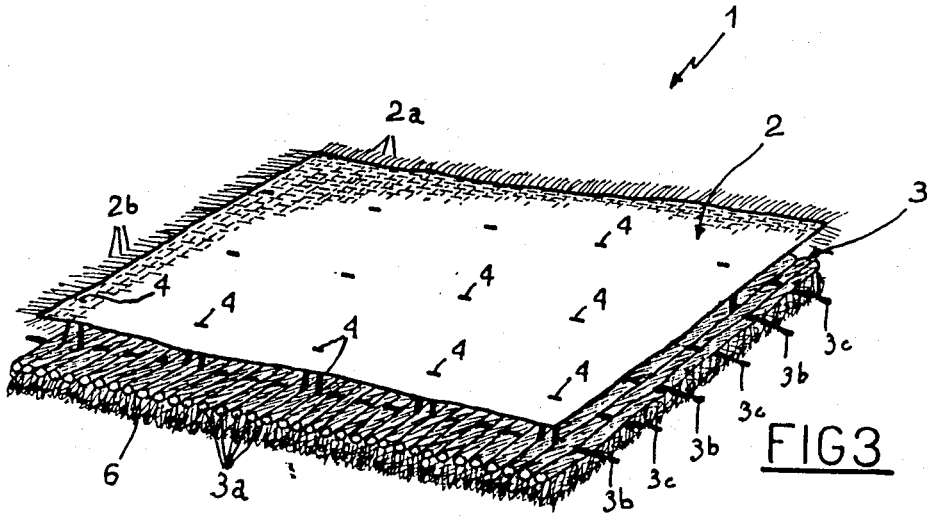
FIG. 3 is a perspective diagrammatic view, to an enlarged scale, of a blanket portion according to a second embodiment of the invention.

As viewed in FIG. 3, where the two fabrics are shown mutually spaced apart from each other for the sake of convenience (as well as in FIG. 1), the warp yarns 3*b* of the lower fabric 3 are interlaced, by means of linking stitches 4 formed by them, with the upper fabric 2 and more particularly with the weft yarns 2*a* of the latter. In FIG. 3, the linking stitches 4 are shown on the upper part of fabric 2 for the sake of convenience but they are practically invisible to an observer as they are hidden by the warp yarns 2*b* of the upper fabric 2.

Obviously it is also possible to join fabrics 2 and 3 together by interlacing the weft yarns 3*a* of the lower fabric 3 with the warp yarns 2*b* of the upper fabric 2. In this case, the warp yarns 3*b* of the lower fabric 3 will be of wool or another suitable material whereas the same material as the upper fabric 2 will be used for the weft yarns.

The linking stitches 4 are suitably spaced apart from each other and distributed such as to form a plurality of air spaces 5, diagrammatically shown in FIG. 2, between fabrics 2 and 3, for the purposes to be described later.

In a preferred embodiment, and as shown in FIG. 3, the linking stitches 4 are aligned with each other according to an alternating symmetric configuration. It is however possible to distribute them according to any other configuration, even randomly, provided that it is adapted to give rise to the creation of a number of air spaces 5 as previously specified.

It may also be provided that one or more auxiliary warp yarns 3*c* should be disposed between the adjoining warp yarns 3*b*, which auxiliary yarns are not interlaced with the weft yarns of the upper fabric 2.

In addition, blanket 1 advantageously shows one visible surface provided with teaseling and napping; said surface, marked by reference numeral 6, is obtained underneath the lower fabric 3, as will be more clear in the following.

On top of the upper fabric 2, it is also provided a visible surface having ornamental patterns printed thereon; said surface is shown by way of example only in FIG. 1 where it has been identified at 7.

According to a second embodiment, shown in FIG. 3, said top surface 7 appears chromatically homogeneous, that is devoid of ornamental printed patterns.

Figure 2:
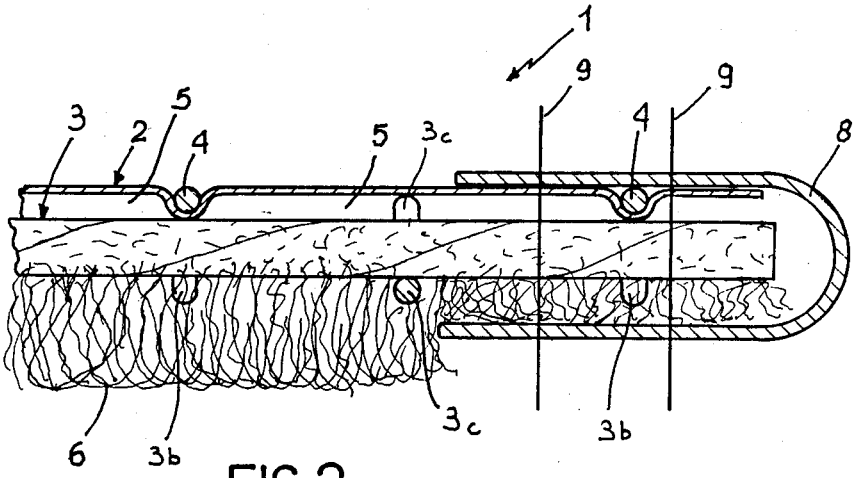
FIG. 2 is an enlarged diagrammatic section of a side portion of a blanket according to the invention.

Blanket 1 can also be hemmed on its four edges with a ribbon 8 fastened by one or more seams 9, as shown in the sewing scheme of FIG. 2.

Figure 4:
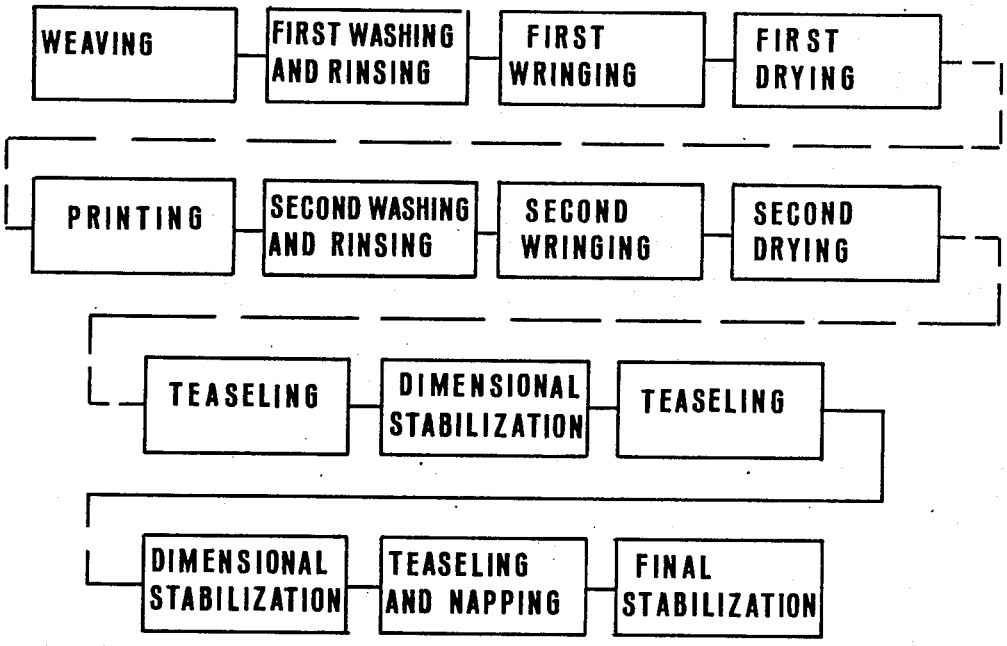
FIG. 4 is a block diagram showing the sequence of the working steps in accordance with a preferred embodiment of the present invention.

Blanket 1 is obtained, in accordance with the present invention, by a process which, as viewed in FIG. 4, provides a weaving step for a manufactured product comprised of an upper fabric, the weft yarns of which are interlaced with the warp yarns of a lower fabric in the region of linking stitches formed by said warp yarns. It is clear that said upper and lower fabrics correspond to the upper fabric 2 and lower fabric 3, respectively, as described with reference to the finished blanket 1, apart from the fact that at the end of the weaving step, the lower fabric 3 has not yet been teaseled and napped and the upper fabric 2 is devoid of any printed pattern.

It is also note-worthy, as previously stated, that the upper fabric of the manufactured product might have its warp yarns interlaced with the weft yarns of the lower fabric without departing from the scope of the present invention.

After the weaving step, the manufactured product is submitted to a first washing and rinsing step aiming at eliminating all impurities, such as oil, fatty matters and the like, that are likely to have been absorbed by said product during the preceding working.

A first drying of the manufactured product now takes place and it is preferably preceded by a first wringing step which is carried out by letting the manufactured product pass between two opposed rollers so as to eliminate the excess water. The real drying is preferably performed by hot air ventilation.

At this point, a printing step is carried out on the upper fabric of the manufactured product in order to produce the above specified ornamental patterns on the top surface 7.

Then a second washing and rinsing step occurs for the purpose of eliminating all impurities due to printing (excess ink and the like) as well as a second drying, after wringing, of the manufactured product.

Afterwards, the manufactured product is submitted to a teaseling step carried out on the visible surface of the lower fabric. This teaseling step consists in raising, by suitable machines known per se, the fibers forming the wool yarns engaged in the accomplishment of said second fabric. It is known that teaseling causes a lengthwise shrinkage of the wool yarns submitted to this operation. Therefore the lower fabric tends to shrink lengthwise or widthwise depending on whether the weft yarns or the warp yarns are teaseled.

Under this situation, the upper fabric is compelled to favour these shrinkages and it bulges in the areas between two adjoining linking stitches 4, which gives rise to wrinkles.

Advantageously by the process in question, it is possible to eliminate these effects by a dimensional stabilization step immediately following the teaseling. This dimensional stabilization step is carried out by submitting the teaseled manufactured product to a combined action consisting in moistening, heating and tensioning the manufactured product in the direction of the longitudinal extension of the teaseled yarns. Moistening and heating are preferably achieved by a steam jet and they aim at dissolving the keratin present in the wool used to make the manufactured product.

Tensioning is carried out by suitable means that is not described here as known per se and not important to the ends of the present invention; said means acts on the opposed edges of the manufactured product, tensing it in order to cause its widening in the longitudinal direction of the teaseled yarns. The latter, which in the preferred embodiment of the invention are represented by the weft yarns 3a of the lower fabric 3, are therefore stretched until they reach the starting size of the manufactured product. It is possible to understand when the stretching must be stopped because when the starting size is reached the upper fabric appears flat, all the above described wrinkles being eliminated, and it is therefore capable of resisting the action of the tensioning means. This action will last until the manufactured product, after the end of the heating and moistening steps carried out by steam, has become cool and keratin by its solidification has produced the dimensional stability of the product itself.

In a preferred embodiment the two last mentioned steps, that is teaseling and dimensional stabilization, are provided to take place a predetermined number of times alternatively and repeatedly, on the basis of different factors, among which particular importance is given to the type of wool used in producing the manufactured product and to the type of teaseling it is wished to achieve. In other words, instead of carrying out the teaseling so as to bring the product to the desired result by a single operation, the teaseling step is performed on several occasions and each time effects of moderate importance are produced on the manufactured product as regards both the achieved teaseling and the dimensional shrinkage of the manufactured product; furthermore the teaseling step is each time followed by a dimensional stabilization step. In this way, any possibility of yielding of the product is eliminated, which on the contrary would be likely to occur if a single teaseling involving a subsequent remarkable dimensional shrinkage should be carried out followed by a single dimensional stabilization step in order to make the product reach the desired size again.

At the end of these teaseling and dimensional stabilization steps, a teaseling and napping operation is carried out on the previously teaseled surface. In this step, teaseling aims at raising the wool fibers with respect to the fabric, as said fibers due to the steam jet used during the dimensional stabilization step may have taken an orientation parallel to the fabric. Napping, in turn, substantially consists in giving a loop conformation to each of the fibers forming the teaseled surface, while disposing the same according to a common predetermined orientation. This operation aims at preventing the teaseled surface from shrinking, which would otherwise take place due to the entanglement of the fibers as a result of rubbing actions during the normal use of the blanket.

The napping step is followed by a final dimensional stabilization step, obtained in a way substantially similar to that described with reference to the preceding stabilization step.

When the last step is over, blankets have to be cut, that is they are cut to measure and the above mentioned ribbons 8 are applied thereto.

Blankets according to the embodiment described with reference to FIG. 3 are obtained by a process substantially identical to the above one, apart from the fact that in this case the material used to make the upper fabric has been dyed before being woven and that the printing, the second washing and the second drying of the material are not carried out.

The invention attains the intended purposes.

By the described process, it is in fact possible to produce blankets having several advantages with respect to the known ones.

One advantage is given by the fact that the blankets in accordance with the invention have a greater heat-insulating property, the weight per surface unit being equal, as compared to the traditional blankets. This is due to the fact that in the blanket in question, it is possible to add the insulation produced by the presence of the air spaces 5 between the upper fabric 2 and the lower fabric 3 to the insulation produced by the teaseled surface 6.

Furthermore and advantageously, the insulating power of the blankets of the invention is not subject to decrease when blankets are washed many times. In fact, even if a shrinkage of the teaseled surface 6 should occur when the blanket 1 is washed, a light dimensional shrinkage of the lower fabric would also simultaneously take place, by virtue of the inner tensions existing in the blanket as a result of the above described dimensional stabilization operations. The above shrinkage would in turn cause an increase in volume of air spaces 5, as the upper fabric would tend to favour said shrinkage by slightly bulging in the region of its areas defined by the adjoining linking stitches 4.

As in this case the air present in the air spaces 5 would increase, the insulating property of the blanket 1 would not change even if a shrinkage of the teaseled and napped surface 6 has taken place.

A further advantage of the blanket in question resides in that it can be provided with printed ornamental patterns, so that it also performs the function of a bedspread due to its aesthetic appearance. It is clear that this advantage has a positive effect both from an economical and a practical point of view in use.

In addition, said blanket can be produced at lower prices than known blankets. In fact, with this blanket, and taking into account the same weight values per surface unit, it is possible to achieve a greater insulation than with the traditional blankets made of wool without necessarily using wool or other valuable materials.

It is understood that many modifications and variations may be made to the present invention without departing from the scope of the inventive idea characterizing it.

What is claimed is:

1. A process for the manufacture of a blanket product comprising the following steps:

weaving of an upper fabric having weft and warp yarns with a lower fabric having weft and warp yarns such that at least some of the warp yarns of one of the fabrics are interlaced with the weft yarns of the other fabric to produce a woven product, said lower fabric weft yarns being wool;

washing of the product;

drying of the product;

after washing the product, at least one step of teaseling the wool yarns of the lower fabric and dimensional stabilization of the teaseled product; said dimensional stabilization being a combined action of moistening, heating and tensioning the product in the direction of the longitudinal extension of the teaseled yarns, said tensioning still lasting at the end of the heating and moistening operations; and a final step of teaseling the wool yarns of the lower fabric, napping the teaseled yarns, and dimensional stabilization of the napped yarns whereby in said final step the teaseling raises the wool fibers which may have been compressed during stabilization and the napping imparts a loop conformation to the raised fibers.

2. The process of claim 1 wherein, before the final teaseling and napping step, there are at least two successive teaseling and dimensional stabilization steps.

3. The process of claim 1 wherein, after washing of the product and before the teaseling operation, the following steps are carried out:

drying of the product;

printing of the upper fabric of the product;

a second washing of the product; and a second drying of the product.

4. The process of claim 1 wherein at least some of the upper fabric weft yarns are interlaced with the warp yarns of the lower fabric in a region of linking stitches formed by the latter.

5. The process of claim 4, wherein, before the final teaseling and napping step, there are at least two successive teaseling and dimensional stabilization steps.

6. The process of claim 4, wherein, after washing of the product and before the teaseling operation, the following steps are carried out:

drying of the product;

printing of the upper fabric of the product;

a second washing of the product; and a second drying of the product.

* * * * *